US010341761B2

(12) United States Patent
Thompson et al.

(10) Patent No.: US 10,341,761 B2
(45) Date of Patent: Jul. 2, 2019

(54) ACOUSTIC WAVEGUIDE FOR AUDIO SPEAKER

(71) Applicant: Tymphany HK Limited, Wanchai (HK)

(72) Inventors: James Thompson, Novato, CA (US); Kaili Wang, Taoyuan (TW)

(73) Assignee: Tymphany HK Limited, Wanchai (HK)

( * ) Notice: Subject to any disclaimer, the term of this patent is extended or adjusted under 35 U.S.C. 154(b) by 0 days.

(21) Appl. No.: 15/900,111

(22) Filed: Feb. 20, 2018

(65) Prior Publication Data

US 2018/0242075 A1 Aug. 23, 2018

Related U.S. Application Data

(60) Provisional application No. 62/460,202, filed on Feb. 17, 2017.

(51) Int. Cl.

| | |
|---|---|
| ***H04R 1/24*** | (2006.01) |
| ***H04R 1/28*** | (2006.01) |
| ***H04R 1/02*** | (2006.01) |
| ***H04R 1/26*** | (2006.01) |

(52) U.S. Cl.

CPC ..... *H04R 1/24* (2013.01); *H04R 1/025* (2013.01); *H04R 1/26* (2013.01); *H04R 1/2857* (2013.01); *H04R 1/2811* (2013.01); *H04R 2499/11* (2013.01)

(58) Field of Classification Search

None

See application file for complete search history.

(56) References Cited

U.S. PATENT DOCUMENTS

| | | | |
|---|---|---|---|
| 1,759,556 | A | 5/1930 | Hutchison |
| 3,892,917 | A | 7/1975 | Sotome |
| 4,200,170 | A | 4/1980 | Williams, Jr. |
| 4,836,328 | A | 6/1989 | Ferralli |
| 4,850,452 | A | 7/1989 | Wolcott |
| 5,086,871 | A | 2/1992 | Barbe |
| 5,115,882 | A | 5/1992 | Woody |
| 5,268,538 | A | 12/1993 | Queen |
| 6,064,744 | A | 5/2000 | Augustin |
| 6,257,365 | B1 | 7/2001 | Hulsebus, II |
| 8,130,994 | B2 | 3/2012 | Button et al. |
| 9,544,681 | B2 | 1/2017 | Kim et al. |
| 9,549,237 | B2 | 1/2017 | Devantier et al. |

(Continued)

FOREIGN PATENT DOCUMENTS

| | | | |
|---|---|---|---|
| CN | 1235688 | A | 11/1999 |
| CN | 2420807 | Y | 2/2001 |
| CN | 201374805 | Y | 12/2009 |

(Continued)

*Primary Examiner* — Peter Vincent Agustin

(74) *Attorney, Agent, or Firm* — Muncy, Geissler, Olds & Lowe, P.C.

(57) ABSTRACT

A portable audio system includes a housing defining a common acoustic cavity a woofer disposed at a first end of the housing in the common acoustic cavity and a tweeter disposed at a second end of the housing, opposite to the first end, in the common acoustic cavity facing the woofer. A waveguide is disposed in the common acoustic cavity between the woofer and the tweeter to separate the woofer and the tweeter. The waveguide disperses and distributes sound waves generated by the woofer and tweeter.

11 Claims, 4 Drawing Sheets

(56) References Cited

U.S. PATENT DOCUMENTS

| | | | | |
|---|---|---|---|---|
| 2003/0118194 | A1* | 6/2003 | Neumann | H04S 1/002 381/59 |
| 2004/0071298 | A1 | 4/2004 | Geeng | |
| 2010/0124340 | A1* | 5/2010 | Knieschewski | H04R 1/24 381/87 |
| 2012/0201403 | A1* | 8/2012 | Tan | H04R 1/345 381/182 |
| 2013/0064402 | A1* | 3/2013 | Sandaire | H04R 5/02 381/300 |
| 2017/0006376 | A1* | 1/2017 | Tan | H04R 1/20 |
| 2017/0311075 | A1* | 10/2017 | Vaisanen | H04R 1/345 |

FOREIGN PATENT DOCUMENTS

| | | | |
|---|---|---|---|
| CN | 203136129 | U | 8/2013 |
| CN | 103581792 | A | 2/2014 |
| CN | 203675294 | U | 6/2014 |
| DE | 718134 | C | 3/1942 |
| DE | 1079675 | B | 4/1960 |
| DE | 2162347 | A1 | 6/1973 |
| DE | 4331959 | A1 | 6/1994 |
| DE | 19527499 | C1 | 7/1996 |
| DE | 19716315 | A1 | 2/1998 |
| DE | 29724374 | U1 | 12/2000 |
| DE | 19953770 | A1 | 1/2001 |
| DE | 102005050231 | A1 | 4/2007 |
| DE | 202012000148 | U1 | 3/2012 |
| EP | 0362097 | A1 | 4/1990 |
| EP | 0400133 | A1 | 12/1990 |
| EP | 0518668 | A2 | 12/1992 |
| EP | 0923774 | A1 | 6/1999 |
| FR | 2163600 | A1 | 7/1973 |

* cited by examiner

140

ACOUSTIC WAVEGUIDE FOR AUDIO SPEAKER

CROSS REFERENCE TO RELATED APPLICATIONS

This nonprovisional application claims priority to U.S. Provisional Application No. 62/460,202, which was filed on Feb. 17, 2017, and which is herein incorporated by reference.

BACKGROUND OF THE INVENTION

Field of the Invention

The present invention relates to an audio system and more particularly to an audio system including an acoustic diffuser, for example an acoustic waveguide, between the drivers/transducers of the audio system.

Description of the Background Art

Drivers are transducers that generate various ranges of sound frequencies. Audio systems/speakers are known to include a plurality of drivers that are configured to generate sounds of varying frequencies. Audio systems/speakers often use multiple drivers to enhance sound quality. For example, audio systems/speakers often will use tweeters for producing sound in a high-frequency range, woofers for producing sound in a low frequency range and midrange drivers for producing sound in midrange frequencies. Providing such combinations of multiple drivers can advantageously cover all ranges of audible sound. Typically, the drivers are mounted coaxially. Such speakers are commonly referred to as omnidirectional speakers.

For example, U.S. Pat. No. 8,130,994 is directed to a speaker with two drivers. Specifically, the speaker includes a woofer and tweeter that are coaxially aligned and project sound toward a same direction. The speaker also includes a waveguide that works as a low pass filter for facilitating low frequencies.

Furthermore, U.S. Pat. No. 9,549,237 is directed to a speaker having two drivers, each having a waveguide. The two drivers include a woofer and tweeter coaxially aligned and disposed apart from one another.

A problem with such speakers, however, is that it is difficult to reduce the size of the audio system/speaker. Additionally, using, for example, a woofer in combination with a tweeter can result in intermodulation distortion.

SUMMARY OF THE INVENTION

In view of the foregoing and other exemplary problems, drawbacks, and disadvantages of the conventional methods and structures, an exemplary feature of the present invention is to provide a speaker/audio system with improved omnidirectional sound quality.

According to a first non-limiting, exemplary aspect of the invention an audio system includes a pair of loudspeakers disposed in a common acoustic cavity and an acoustic diffuser disposed in the common acoustic cavity between the pair of loudspeakers.

According to a second non-limiting, exemplary aspect of the invention, a portable audio system includes a housing defining a common acoustic cavity, a woofer disposed at a first end of the housing in the common acoustic cavity, a tweeter disposed at a second end of the housing, opposite to the first end, in the common acoustic cavity facing the woofer and a waveguide disposed in the common acoustic cavity between the woofer and the tweeter.

According to a third non-limiting, exemplary aspect of the invention, a portable audio system includes a woofer, a tweeter and a waveguide disposed between the woofer and the tweeter. The waveguide includes a first main surface facing the woofer and a second main surface facing the tweeter. The first main surface and the second main surface are smoothly connected to each other.

In accordance with the exemplary aspects described above, the present invention is able to provide an omnidirectional speaker/audio system with improved sound directivity (i.e., more even from different angles). Furthermore, the speaker/audio system is able to provide a flatter frequency response. Finally, the speaker/audio system is able to reduce or eliminate intermodulation distortion as a result of the drivers (e.g., tweeter and woofer) acoustically interacting with each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, do not limit the present invention, and wherein.

DETAILED DESCRIPTION

Figure 1:
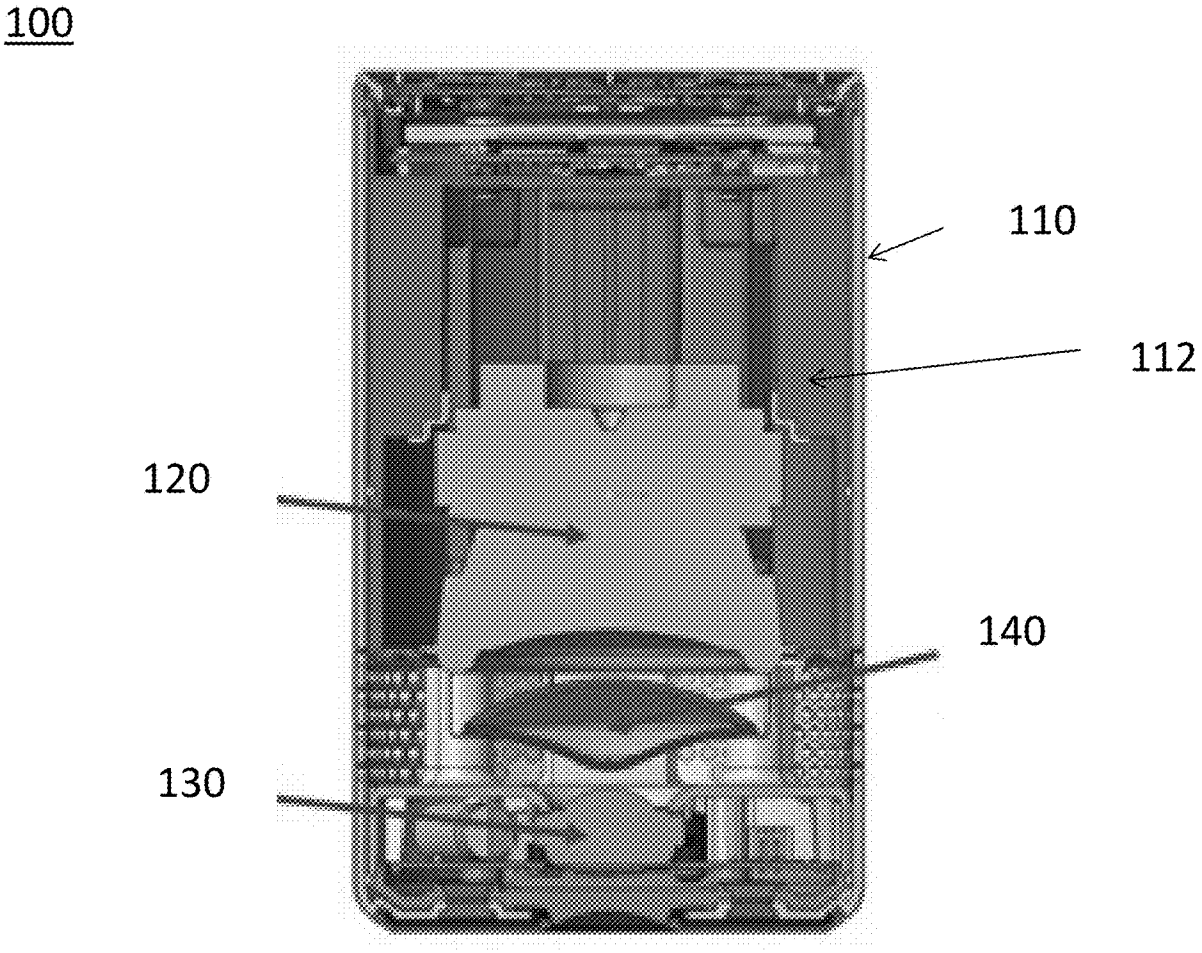
FIG. 1 illustrates a cross-sectional view of a portable speaker according to an exemplary embodiment of the present invention.

Referring now to the drawings, and more particularly to FIGS. 1-3B, there are shown exemplary embodiments of the present invention.

FIG. 1 illustrates a speaker 100 in accordance with an exemplary, non-limiting embodiment of the present invention. In particular, the speaker 100 is a portable speaker. The speaker 100 has an outer housing 110 defining an acoustic cavity 112. In the compact/portable speaker 100 of the present invention, the acoustic cavity 112 is a common acoustic cavity in that all components of the speaker 100 are disposed within a same acoustic cavity.

The speaker 100 includes a pair of drivers/loudspeakers. Specifically, the speaker 100 includes a tweeter 130 and a woofer 120. The tweeter 130 and the woofer 120 are optimized to be efficient, reproducing different frequencies. That is, the tweeter 130 and the woofer 120 are configured to reproduce different frequency regions. The tweeter 130 is a high frequency driver that may generate sound over a range of 2,000 Hz to 20,000 Hz, for example. The woofer 120 is a low frequency driver that may generate sound over a range of 40 Hz to 500 Hz.

Figure 2:
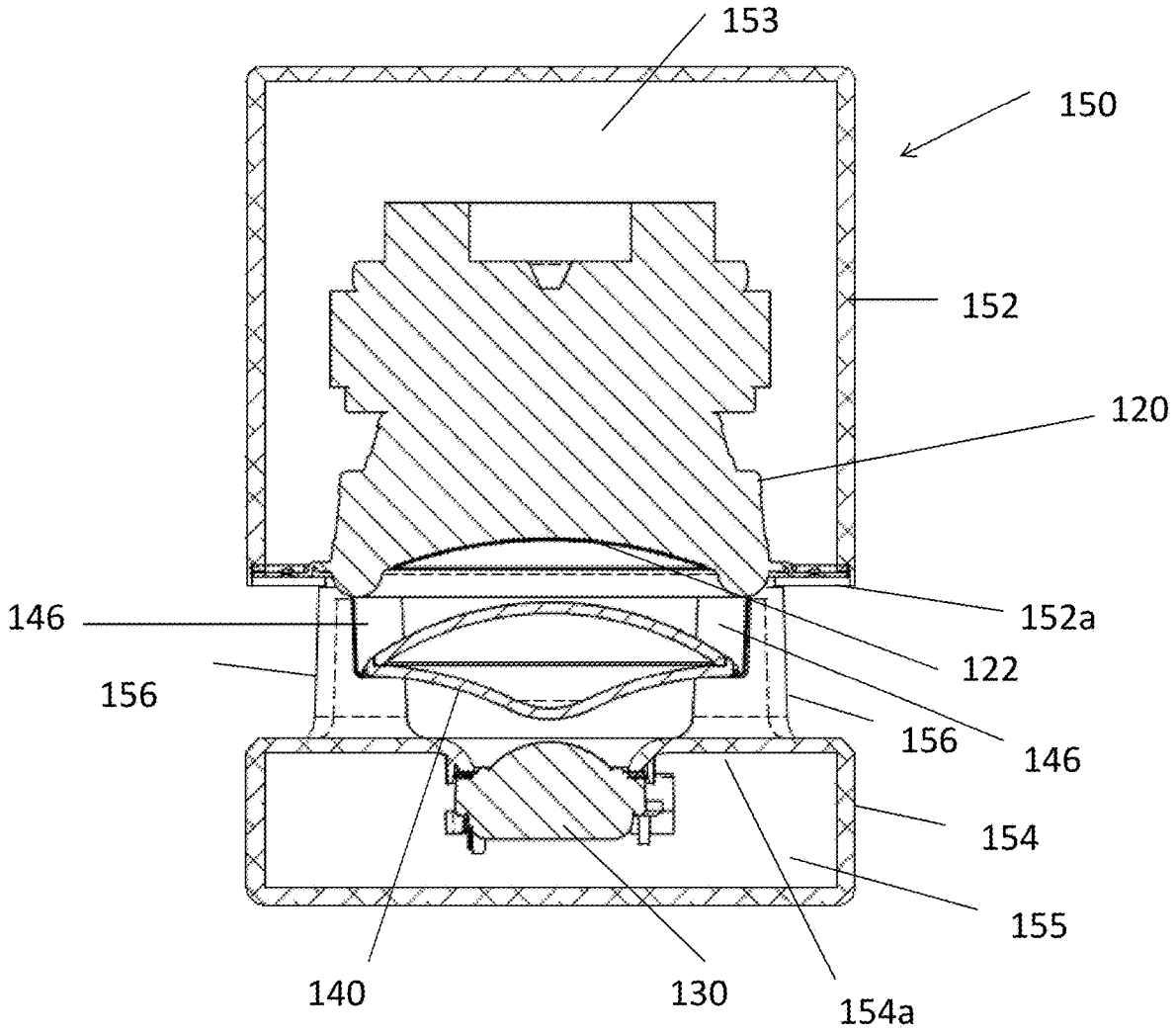
FIG. 2 illustrates a cross-sectional view of components of the portable speaker illustrated in FIG. 1.

As is more clearly illustrated in FIG. 2, the woofer 120 and tweeter 130 are held within the housing 110 by a frame 150. The frame 150 has a first frame portion 152 holding the woofer 120 and a second frame portion 154 holding the tweeter 130. The first frame portion 152 and the second frame portion 154 are connected by frame columns 156. The first frame portion 152 has a bottom portion 152*a*. The woofer 120 is secured to the bottom portion 152*a*. The second frame portion 154 has a top portion 154*a*. The tweeter 130 is secured to the top portion 154*a*. The woofer 120 and the tweeter 130 are mounted such that they face each other. Furthermore, the woofer 120 and tweeter 130 are contained together in the common acoustic cavity 112. The woofer 120 and tweeter 130 are configured to radiate sound within the speaker 100. Moreover, the woofer 120 and the tweeter 130 are mounted coaxially with respect to each other. That is, a center of the tweeter 130 and a center of the woofer 120 are aligned over a common vertical axis. Furthermore, the tweeter 130 and the woofer 120 have different diameters of their radiation surface. For example, in the embodiment illustrated in FIGS. 1 and 2, the woofer 120 has a radiation surface with a diameter larger than a diameter of the radiation surface of the tweeter 130.

The speaker 100 also includes an acoustic waveguide 140 positioned in the common acoustic cavity 112 between the woofer 120 and the tweeter 130. In accordance with certain exemplary embodiments of the present invention the speaker 100 includes only a single waveguide 140 for the woofer 120 and the tweeter 130. That is, in accordance with the present invention, it is not required to provide separate waveguides for the individual drivers/loudspeakers.

The waveguide 140 is an acoustic diffuser that is configured to disperse and distribute the sound waves from the woofer 120 and the tweeter 130 so that the speaker 100 provides an omnidirectional radiation pattern at least along one axis. The waveguide 130 eliminates the intermodulation distortion as a result of both transducers acoustically interacting with each other, specifically at above 8 kHz.

Figure 3A:
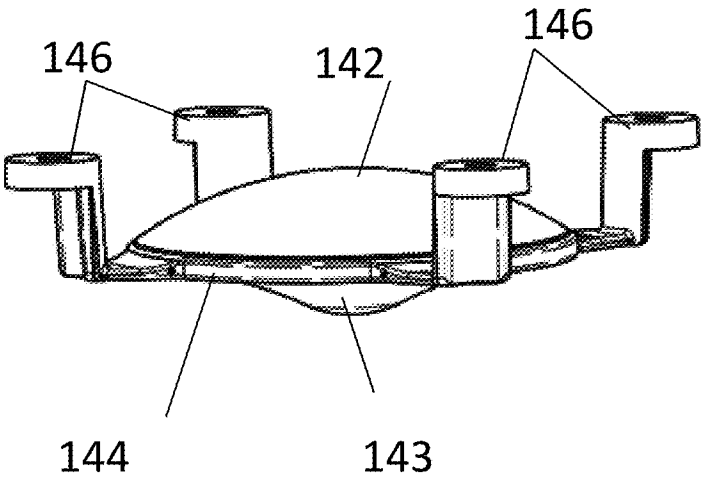
FIG. 3A is a perspective view of a waveguide of the portable speaker illustrated in FIG. 1.
Figure 3B:
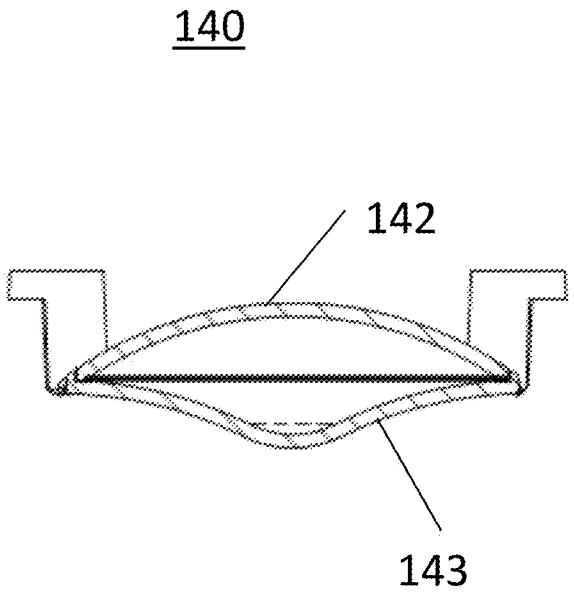
FIG. 3B is a cross-sectional view of the waveguide illustrated in FIG. 3A.

The waveguide 140 is illustrated in further detail in FIGS. 3A and 3B. The waveguide 140 includes a first main surface 142 and a second main surface 143 that are smoothly connected to one another. The first main surface 142 and the second main surface 143 are held by a frame portion 144. The first main surface 142 and the second main surface respectively face the tweeter 130 and the woofer 120. The two main surfaces 142/143 do not present steep geometries. Instead, the main surfaces are smooth so that air turbulences are minimized. Furthermore, both of the main surfaces 142/143 are asymmetric presenting different geometries. That is, the main surface that faces the largest of the drivers/loudspeakers has a convex geometry while the main surface that faces the smallest of the drivers/loudspeakers has a very smooth cone or bell-like geometry. As noted above, according to certain exemplary embodiments of the invention, the woofer 120 is larger than the tweeter 130. Thus, in the exemplary configuration in FIGS. 1 and 2, the first main surface 142 faces the woofer 120 and has a convex geometry toward the woofer 120. The second main surface 143 faces the tweeter 130 and has a very smooth cone or bell-like geometry.

The diameter of the waveguide 140 is configured to not exceed the diameter of the radiation surface of the larger of the two drivers/loudspeakers. Again, as noted above, according to certain exemplary embodiments of the invention, the woofer 120 is larger than the tweeter 130. Thus, the diameter of the waveguide 140 is configured to not exceed, in size, the diameter of the radiation surface of the woofer 120.

As is illustrated in FIG. 2, the first portion 152 of the frame 150 forms an acoustic cavity 153, within the common acoustic cavity 112, for the woofer 120. The cone 122 of the woofer has a geometry/shape that matches the geometry/shape of the first main surface 142 of the waveguide 140. Thus, the cone 122 and the first main surface 142 are disposed in parallel. Furthermore, the second portion 154 of the frame 150 forms another acoustic cavity 155 within the common acoustic cavity 112. The tweeter 130 is recessed into the acoustic cavity 155 so that the wall around the tweeter 130 acts as a primary waveguide.

As is illustrated in FIG. 2, the waveguide 140 is mounted to the bottom portion 152*a* of the first portion 152 of the frame 150. Specifically, the waveguide 140 is mounted by mechanical elements 146. As is illustrated in FIG. 3B, the waveguide 140 includes, for example, four mechanical elements 146 connected to the frame portion 144. The mechanical elements 146 are configured to hold the waveguide 140 in place and to not modify the sound waves generated by the drivers. Specifically, the mechanical elements 146 are configured to be as acoustically transparent as possible.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An audio system, comprising:

a pair of loudspeakers disposed in a common acoustic cavity; and an acoustic waveguide disposed in the common acoustic cavity between the pair of loudspeakers, wherein the audio systems includes only one acoustic waveguide, wherein the acoustic waveguide comprises:

a first main surface facing the woofer; and a second main surface facing the tweeter, wherein the first main surface and the second main surface are smoothly connected to each other, and wherein the first main surface is convex facing the woofer and the second main surface is bell-shaped facing the tweeter.

2. The audio system according to claim 1, wherein the pair of loudspeakers are coaxially aligned.

3. The audio system according to claim 1, wherein the pair of loudspeakers include a tweeter and a woofer.

4. The audio system according to claim 3, wherein the tweeter is recessed in a cavity within the common acoustic cavity.

5. The audio system according to claim 1, wherein a diameter of the waveguide does not exceed in size a diameter of a radiation surface of the woofer.

6. The audio system according to claim 1, wherein the waveguide is mounted within the audio system by a plurality of mechanical elements.

7. The audio system according to claim 1, wherein a cone of the woofer has a same shape as the first main surface.

8. The audio system according to claim 1, wherein a cone of the woofer is disposed parallel to the first main surface.

9. The audio system according to claim 6, wherein the mechanical elements are acoustically transparent.

10. A portable audio system, comprising:

a housing defining a common acoustic cavity;

a woofer disposed at a first end of the housing in the common acoustic cavity;

a tweeter disposed at a second end of the housing, opposite to the first end, in the common acoustic cavity facing the woofer;

a waveguide disposed in the common acoustic cavity between the woofer and the tweeter, wherein the audio systems includes only one waveguide, wherein the waveguide comprises:

a first main surface facing the woofer; and a second main surface facing the tweeter, wherein the first main surface and the second main surface are smoothly connected to each other, and wherein the first main surface is convex facing the woofer and the second main surface is bell-shaped facing the tweeter.

11. A portable audio system, comprising:

a woofer;

a tweeter; and a waveguide disposed between the woofer and the tweeter, the waveguide comprising:

a first main surface facing the woofer; and a second main surface facing the tweeter, wherein the first main surface and the second main surface are smoothly connected to each other, wherein the audio systems includes only one waveguide, and wherein the first main surface is convex facing the woofer and the second main surface is bell-shaped facing the tweeter.

* * * * *